US008572980B2

(12) United States Patent
Winkler et al.

(10) Patent No.: US 8,572,980 B2
(45) Date of Patent: Nov. 5, 2013

(54) COOLING SCHEME FOR AN INCREASED GAS TURBINE EFFICIENCY

(75) Inventors: Anton Winkler, Olching (DE); Urs Benz, Gipf-Oberfrick (CH); Andre Theuer, Baden (CH); Diane Lauffer, Wettingen (CH); Madhavan Poyyapakkam, Rotkreuz (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/465,830

(22) Filed: May 7, 2012

(65) Prior Publication Data

US 2012/0324863 A1 Dec. 27, 2012

Related U.S. Application Data

(63) Continuation of application No. PCT/EP2010/066513, filed on Oct. 29, 2010.

(30) Foreign Application Priority Data

Nov. 7, 2009 (CH) ..... 1888/09

(51) Int. Cl.
*F02C 1/00* (2006.01)
*F02C 3/20* (2006.01)

(52) U.S. Cl.
USPC ..... 60/742; 60/39.463; 60/746

(58) Field of Classification Search
USPC ..... 60/748, 742, 740, 39.463, 761, 763, 60/765, 804, 239, 402, 403, 404, 405; 239/402, 404, 405, 403; 431/174; 122/6.5, 6.6; 432/23
See application file for complete search history.

(56) References Cited

U.S. PATENT DOCUMENTS 580,360 A 4/1897 Bachy
2,478,851 A 8/1949 Traupel
2,944,388 A * 7/1960 Bayer ..... 60/762

(Continued)

FOREIGN PATENT DOCUMENTS

EP 0 473 371 A1 3/1992
EP 0 911 585 A1 4/1999

(Continued)

OTHER PUBLICATIONS

Morris, Analyses for Turbojet Thrust Augmentation with Fuel-Rich Afterburning of Hydrogen, Diborane, and Hydrazine, National Advisory Commitee for Aeronautics, 1957, p. 1.*

(Continued)

*Primary Examiner* — William H Rodriguez
*Assistant Examiner* — William Breazeal
(74) *Attorney, Agent, or Firm* — Buchanan Ingersoll & Rooney PC

(57) ABSTRACT

A burner for a combustion chamber of a turbine, with an injection device for the introduction of at least one gaseous and/or liquid fuel into the burner is proposed. The injection device has at least one body arranged in the burner with at least two nozzles for introducing the at least one fuel into the burner, the body being configured with a streamlined cross-sectional profile which extends with a longitudinal direction perpendicularly or at an inclination to a main flow direction prevailing in the burner. The carrier air plenum is provided with holes such that carrier air exiting through the holes impinges an inner side of a leading edge portion of the body.

17 Claims, 6 Drawing Sheets

(56) References Cited

U.S. PATENT DOCUMENTS

| | | | | |
|---|---|---|---|---|
| 3,373,567 | A | 3/1968 | Palfreyman et al. | |
| 3,620,012 | A | 11/1971 | Wilde | |
| 4,830,315 | A | 5/1989 | Presz, Jr. et al. | |
| 4,887,425 | A | 12/1989 | Vdoviak | |
| 4,932,861 | A | 6/1990 | Keller et al. | |
| 5,203,796 | A | 4/1993 | Washam et al. | |
| 5,235,813 | A | 8/1993 | McVey et al. | |
| 5,251,447 | A | 10/1993 | Joshi et al. | |
| 5,297,391 | A | 3/1994 | Roche | |
| 5,315,815 | A | 5/1994 | McVey et al. | |
| 5,351,477 | A | 10/1994 | Joshi et al. | |
| 5,423,608 | A | 6/1995 | Chyou et al. | |
| 5,431,018 | A | 7/1995 | Keller et al. | |
| 5,433,596 | A | 7/1995 | Dobbeling et al. | |
| 5,487,659 | A | 1/1996 | Eroglu et al. | |
| 5,511,375 | A | 4/1996 | Joshi et al. | |
| 5,513,982 | A | 5/1996 | Althaus et al. | |
| 5,593,302 | A | 1/1997 | Althaus et al. | |
| 5,622,054 | A | 4/1997 | Tingle | |
| 5,626,017 | A | 5/1997 | Sattelmayer | |
| 5,638,682 | A | 6/1997 | Joshi et al. | |
| 5,647,200 | A | 7/1997 | Althaus | |
| 5,735,126 | A * | 4/1998 | Schulte-Werning | 60/732 |
| 5,794,449 | A | 8/1998 | Razdan et al. | |
| 5,803,602 | A | 9/1998 | Eroglu et al. | |
| 5,813,232 | A | 9/1998 | Razdan et al. | |
| 5,865,024 | A | 2/1999 | Kress et al. | |
| 5,941,064 | A | 8/1999 | Chevalier et al. | |
| 6,082,111 | A | 7/2000 | Stokes | |
| 6,112,516 | A | 9/2000 | Beule et al. | |
| 6,263,660 | B1 | 7/2001 | Lawlor | |
| 6,460,326 | B2 | 10/2002 | Bechtel et al. | |
| 6,786,430 | B2 * | 9/2004 | Hayashi | 239/406 |
| 6,795,192 | B2 | 9/2004 | Dickopf et al. | |
| 8,047,001 | B2 | 11/2011 | Beeck et al. | |
| 2002/0038542 | A1 | 4/2002 | Akama et al. | |
| 2002/0187448 | A1 | 12/2002 | Eroglu et al. | |
| 2003/0128364 | A1 | 7/2003 | Dickopf et al. | |
| 2006/0016192 | A1 | 1/2006 | Bunel et al. | |
| 2006/0230764 | A1 | 10/2006 | Schmotolocha et al. | |
| 2007/0033945 | A1 | 2/2007 | Goldmeer et al. | |
| 2007/0151250 | A1 * | 7/2007 | Haynes | 60/772 |
| 2008/0078182 | A1 | 4/2008 | Evulet | |
| 2009/0081048 | A1 | 3/2009 | Beeck et al. | |
| 2010/0300109 | A1 | 12/2010 | Carroni et al. | |

FOREIGN PATENT DOCUMENTS

| | | | |
|---|---|---|---|
| EP | 1 434 007 | A2 | 6/2004 |
| EP | 1 619 441 | A1 | 1/2006 |
| EP | 1 752 709 | A2 | 2/2007 |
| EP | 1 257 809 | B1 | 10/2007 |
| EP | 1 847 696 | A1 | 10/2007 |
| EP | 2 072 899 | A1 | 6/2009 |
| GB | 2 216 999 | A1 | 10/1989 |
| GB | 2 293 001 | A | 3/1996 |
| JP | 54-121425 | A | 9/1979 |
| WO | WO 00/19081 | A2 | 4/2000 |
| WO | 2009019113 | A2 | 2/2009 |

OTHER PUBLICATIONS

Lundin, Summary of NACA Research on Afterburners for Turbojet Engines, 1956, p. 20.*

Cumpsty, "Jet Propulsion: A Simple Guide to the Aerodynamic and Thermodynamic Design and Performance of Jet Engines", 2003 2nd Ed. Cambridge University Press, p. 229.

Flack, Fundamentals of Jet Propulsion with Applications, 2005, Cambridge Press, p. 19.

Office Action, dated Jun. 21, 2013, issued in U.S. Appl. No. 13/465,752.

* cited by examiner

COOLING SCHEME FOR AN INCREASED GAS TURBINE EFFICIENCY

RELATED APPLICATION(S)

This application claims priority as a continuation application under 35 U.S.C. §120 to PCT/EP2010/066513, which was filed as an International Application on Oct. 29, 2010 designating the U.S., and which claims priority to European Application 01888/09 filed in Europe on Nov. 7, 2009. The entire contents of these applications are hereby incorporated by reference in their entireties.

FIELD

A fuel lance is disclosed for a burner for a primary combustion chamber of a turbine or secondary combustion chamber of a turbine with sequential combustion having a first and a secondary combustion chamber, for the introduction of at least one gaseous and/or liquid fuel into the burner. Modifications to a cooling scheme of the fuel lance are proposed to increase the gas turbine engine efficiency as well as to simplify the design.

BACKGROUND INFORMATION

In order to achieve improved efficiency, a high turbine inlet temperature is used in standard gas turbines. As a result, there can arise relatively high NOx emission levels and relatively high life cycle costs. These can be mitigated with a sequential combustion cycle, wherein the compressor can deliver a relatively higher pressure ratio one. The main flow passes the first combustion chamber (for example, using a burner of the general type as disclosed in EP 1 257 809 or as in U.S. Pat. No. 4,932,861, also called an EV combustor, where the EV stands for environmental), wherein a part of the fuel is combusted. After expanding at the high-pressure turbine stage, the remaining fuel is added and combusted (for example, using a burner of the type as disclosed in U.S. Pat. No. 5,431,018 or U.S. Pat. No. 5,626,017 or in U.S. Patent Application Publication No. 2002/0187448, also called SEV combustor, where the S stands for sequential). Both combustors contain premixing burners, as relatively low NOx emissions can require high mixing quality of the fuel and the oxidizer.

Because the second combustor is fed by expanded exhaust gas of the first combustor, the operating conditions can allow self ignition (spontaneous ignition) of the fuel air mixture without additional energy being supplied to the mixture. To prevent ignition of the fuel air mixture in the mixing region, the residence time therein should not exceed the auto ignition delay time. This can ensure flame-free zones inside the burner but poses challenges in obtaining appropriate distribution of the fuel across the burner exit area.

SEV-burners can be designed for operation on natural gas and oil only. Therefore, the momentum flux of the fuel can be adjusted relative to the momentum flux of the main flow so as to penetrate into the vortices. The subsequent mixing of the fuel and the oxidizer at the exit of the mixing zone can be just sufficient to allow relatively low NOx emissions (mixing quality) and avoid flashback (residence time), which can be caused by auto ignition of the fuel air mixture in the mixing zone. The cross flow injection used in the known SEV-fuel injection devices (SEV fuel lances) can necessitate high-pressure carrier air supply, which can reduce the overall efficiency of the power plant.

SUMMARY

A burner is disclosed for a combustion chamber of a turbine, comprising: an injection device for the introduction of at least one gaseous and/or liquid fuel into the burner, wherein the injection device includes: at least one body which is arranged in the burner, the at least one body being a streamlined body which has a streamlined cross-sectional profile and which extends with a longitudinal direction perpendicularly or at an inclination to a main flow direction prevailing in the burner, wherein the body has two lateral surfaces substantially parallel to the main flow direction joined at their upstream side by a leading edge portion of the body and joined at their downstream side forming a trailing edge, wherein the body comprises an enclosing outer wall defining the streamlined cross-sectional profile, wherein within this outer wall, there is provided a longitudinal inner carrier air plenum for the introduction of carrier air into the injection device, wherein the carrier air plenum is provided with holes such that carrier air exiting through these holes impinges on an inner side of the leading edge portion of the body; and at least two nozzles for introducing the at least one fuel into the burner, the at least two nozzles being distributed along the trailing edge.

BRIEF DESCRIPTION OF THE DRAWINGS

Exemplary embodiments of the disclosure are described in the following with reference to the drawings, which are for the purpose of illustrating the present exemplary embodiments of the disclosure and not for the purpose of limiting the same. In the drawings.

DETAILED DESCRIPTION

Figure 1:
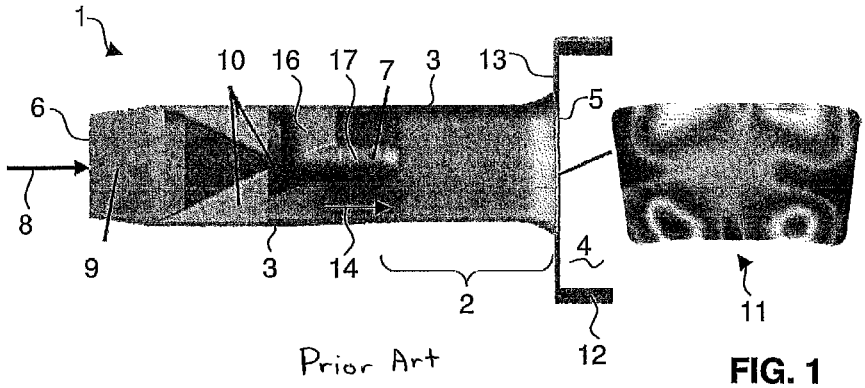
FIG. 1 shows a known secondary burner located downstream of the high-pressure turbine together with the fuel mass fraction contour (right side) at the exit of the burner.

Exemplary embodiments of the present disclosure can provide an improved fuel injection device for combustion chambers of gas turbines. In particular an injection device is disclosed which can be operated with low pressure (carrier) air which at the same time acts as carrier air for fuel injection as well as cooling air.

Exemplary embodiments of the present disclosure relate to a burner for a combustion chamber of a turbine, for example, a gas turbine, with an injection device for the introduction of at least one gaseous and/or liquid fuel into the burner. The injection device has at least one body or lance which is arranged in the burner and extends into the burner cavity. The at least one body has at least two nozzles for introducing the at least one fuel into the burner. The burner can also be arranged as an element including more than one such body located next to each other, for example, a burner with three bodies located next to each other, each with a different inclination angle with respect to the main flow direction. The at least one body can be configured as a streamlined body which has a streamlined cross-sectional profile and which extends with a longitudinal direction perpendicularly (or at a slight inclination) to a main flow direction prevailing in the burner. The body can have two lateral surfaces, at least for one central body, substantially parallel to the main flow direction and converging, i.e. inclined for the other flow direction. These lateral surfaces can be joined at their upstream side by a leading edge portion of the body (for example, a rounded portion) and joined at their downstream side to form a trailing edge (for example, a sharp edge). The at least two nozzles can be located at different longitudinal positions along the substantially straight trailing edge of the body and distributed along the trailing edge. The body includes an enclosing outer wall defining the streamlined cross-sectional profile. Within this outer wall (in the cavity defined thereby), there can be provided a longitudinal inner carrier air plenum (for example, a tubular structure) for the introduction of carrier air into the injection device. The carrier air plenum can be provided with holes such that carrier air exiting through these holes impinges on the inner side of the leading edge portion of the body. The sizes and distribution of these holes can be arranged to provide a uniform carrier air distribution.

In one burner at least one such injection device can be located (for example, at least two or three such injection devices or flutes can be located within one burner).

These holes in the carrier air plenum can be distributed along the longitudinal direction and also in the direction orthogonal thereto, so along the rounded leading edge inner shape.

An injection device according to exemplary embodiments of the disclosure can be used in a primary burner but can also be used in a secondary burner located downstream of a primary combustion chamber responsible for supplying a secondary combustion chamber with fuel, wherein in this secondary combustion chamber the fuel can be auto igniting. The secondary burner can be arranged such that upstream of the body and downstream of a last row of rotating blades of a high-pressure turbine, additional vortex generators can be unnecessary, and additional flow conditioning elements can be unnecessary According to an exemplary embodiment of the disclosure, at least two nozzles can be located at the trailing edge of the body. According to an exemplary embodiment of the disclosure between 4 and 30 nozzles can be located in equidistant distribution along the trailing edge, for injecting fuel and/or carrier gas substantially parallel to the main flow direction (in-line injection).

The injection device according to an exemplary embodiment of the disclosure, can be used for gas or liquid fuel.

According to an exemplary embodiment of the disclosure, the carrier air plenum can be a tubular duct located in the upstream portion of the cavity defined by the outer wall. The expression tubular duct shall not imply a circular cross-section of the duct. The cross-section may be, for example, circular or oval. The cross-section of the tubular duct can have, at least in the portion facing the leading edge part of the outer wall, a similar shape as the outer wall on its inner side. The wall of the tubular duct can be distanced from the outer wall leaving an interspace in between for circulation of carrier air, leading to impingement cooling of the inner wall and at the same time to convective cooling thereafter. The wall of the tubular duct in the region facing the outer wall can run substantially parallel thereto, such that the cooling channel formed between these two walls has a substantially constant cross-section, for example, along the longitudinal direction. The distance between the wall of the tubular duct and the outer wall can be established/maintained by at least one distance keeping element. Such distance keeping elements can be located at the outer wall and/or at the wall of the tubular duct. They can, for example, be in the form of protrusions and/or ridges provided on the inner side of the outer wall.

According to an exemplary embodiment of the disclosure, the carrier air plenum can extend substantially along the full length of the body. The bottom end can be closed by a bottom plate, which can also be provided with holes for impingement cooling of a bottom plate of the body.

In an exemplary embodiment of the disclosure, air exiting from the carrier air plenum can be used as carrier air of the injection devices. In other words carrier air for the fuel injection can be exclusively provided by this carrier air plenum, so the carrier air for the fuel injection first takes the function of cooling of the injection device and after that takes a function of carrier air for fuel injection. The carrier air can exit at the injection devices via an annular slit enclosing a central fuel jet. The central fuel jet can exit via an annular fuel slit, so the central fuel jet can also be an annular fuel jet enclosed by the carrier air.

In an exemplary embodiment of the disclosure, within the enclosing outer wall defining the streamlined cross-sectional profile, there can be provided a longitudinal inner fuel tubing for the introduction of liquid and/or gaseous fuel. In other words the carrier air plenum and this longitudinal inner fuel tubing run parallel within the cavity formed by the outer wall. The longitudinal inner fuel tubing can be provided with branching off tubing leading to the at least two nozzles. The carrier air plenum can be located in the upstream portion of the cavity defined by the outer wall while the longitudinal inner fuel tubing is located in the downstream portion of the cavity defined by the outer wall. Like this, when the carrier air plenum is exclusively located in the upstream portion of the cavity while the longitudinal inner fuel tubing is exclusively located in the downstream portion of the cavity, the fuel supply parts can be optimally shielded from the heat which can be an issue at the leading edge of the device. The wall of the carrier air plenum can be distanced from the wall of the longitudinal inner fuel tubing for circulation of carrier air. In a cross-sectional view, the distance between the wall of the inner fuel tubing and the outer wall and the distance between the wall of the carrier air plenum and the outer wall can be substantially the same so the couple of the inner fuel tubing and the carrier air plenum tubing have a similar outline as the inner side of the outer wall structure leading to an optimum flow cavity for the carrier air. The wall portions of the inner fuel tubing and a carrier air plenum tubing facing each other can be located substantially perpendicular to the main flow direction, and can be distanced from each other such that carrier air can also circulate between these two walls. For example, the longitudinal inner fuel tubing can be circumferentially distanced from the outer wall, defining an interspace for the delivery of carrier air to the at least one nozzle.

In an exemplary embodiment of the disclosure, air exiting from the carrier air plenum exits the injection device via effusion holes, apart from taking over the carrier air function in the fuel nozzles. Such effusion holes can, for example, be located at the trailing edge of the injection device and/or at the lateral surfaces of the injection device and/or at the leading edge of the injection device and/or at large scale mixing devices of the injection device. Such large scale mixing devices can, for example, be vortex generators located at the lateral surfaces upstream of the nozzles which are provided with perforations through which the carrier air can penetrate.

According to an exemplary embodiment of the disclosure, the at least two nozzles can have their outlet orifices downstream of the trailing edge of the streamlined body, leading to an optimum mixing while necessitating only low pressure carrier air. The distance between the substantially straight trailing edge at the position of the nozzle, and the outlet orifice of the nozzle, measured along the main flow direction can be at least 2 mm (for example, at least 3 mm, or in the range of 4-10 mm).

According to an exemplary embodiment of the disclosure, the streamlined body has a cross-sectional profile which can be mirror symmetric (excluding the vortex generators, which may also not be mirror symmetric in their distribution on the lateral faces) with respect to the central plane of the body.

The at least one nozzle can inject fuel and/or carrier gas at an inclination angle between about 0-30° (±10%) with respect to the main flow direction, so there can be in-line injection of the fuel.

According to an exemplary embodiment of the disclosure, within the longitudinal inner fuel tubing provided for gaseous fuel, there can be provided a second inner fuel tubing for a second type of fuel. This second type of fuel can be a liquid fuel and wherein further gaseous fuel can be delivered by the interspace between the walls of said longitudinal inner fuel tubing and the walls of the second inner fuel tubing.

As mentioned above, according to an exemplary embodiment of the disclosure, upstream of the at least one nozzle on at least one lateral surface there can be located at least one vortex generator. The vortex generator can be an attack angle in the range of about 15-20° (±10%) and/or a sweep angle in the range of about 55-65° (±10%). Known vortex generators as disclosed in U.S. Pat. No. 5,803,602 and U.S. Pat. No. 5,423,608 can be used in the present context, the disclosure of these two documents being specifically incorporated into this disclosure by reference. At least two nozzles can be arranged at different positions along the trailing edge, and upstream of each of these nozzles at least one vortex generator can be located. Vortex generators to adjacent nozzles can be located at opposite lateral surfaces. More than three (for example, at least four) nozzles can be arranged along the trailing edge and vortex generators can be alternatingly located at the two lateral surfaces or downstream of each vortex generator there can be located at least two nozzles.

The vortex generator can, as mentioned above, be provided with cooling elements, wherein these cooling elements can be effusion cooling holes provided in at least one of the surfaces of the vortex generator, and wherein effusion or film cooling holes can be fed with air from the carrier gas feed also used for the fuel injection.

According to an exemplary embodiment of the disclosure, the streamlined body can extend across substantially the entire flow cross section between opposite walls of the burner.

The burner can be an annular burner arranged circumferentially with respect to a turbine axis, and between 10-100 streamlined bodies (for example, between 40-80 streamlined bodies) can be arranged around the circumference, for example, all of them equally distributed along the circumference.

The fuel can be injected from the nozzle together with a carrier air stream which can be supplied by the carrier air plenum, and the carrier air can be low pressure air with a pressure in the range of 10-22 bar (for example, in the range of 16-22 bar). This carrier air can be directly derived from a compressor stage without subsequent cooling.

Exemplary embodiments of the present disclosure relate to the use of a burner as defined above in a secondary combustion chamber, for example, the combustion under high reactivity conditions, for the combustion at high burner inlet temperatures and/or for the combustion of MBtu fuel, for example, with a calorific value of 5000-20,000 kJ/kg (for example, 7000-17,000 kJ/kg and 10,000-15,000 kJ/kg) and for example, such a fuel comprising hydrogen gas.

Several design modifications to a known secondary burner (SEV) designs are proposed to introduce a low pressure drop complemented by rapid mixing e.g. for highly reactive fuels and operating conditions. Exemplary embodiments of the disclosure target for a low pressure drop fuel lance system for a reheat flute lance and burner. The (50% or higher) reduced fuel pressure drop in the flute lance is due to less design complexity and the elimination of high momentum flux fuel jets used for known cross flow lance configurations. Herein, a fuel lance cooling concept for inline fuel injection is provided which can eliminate the need for high-pressure (carrier air and fuel) requirements. An injection system with lower fuel pressure drop can increase the likelihood of avoiding the use of fuel compression for the SEV. The low BTU and H2 fuels can require that fuel pressure drops inside the passage may be needed.

The key results can be summarized as follows:

Low fuel momentum flux of the fuel jets in the reheat lances can reduce the fuel pressure requirement.

The lower fuel pressure drop in the lance can offer the possibility for fuel staging to control emissions and pulsations.

Lower fuel pressure drop in the inline injectors can allow for injecting H2 or Syngas with a reasonable pressure.

Flute design can offer uniform fuel distribution across the injectors.

In particular, exemplary embodiments of the disclosure relate to situations where the high-pressure carrier air/cooling air supply, which can be used in known constructions with pressures in the range of about 25-35 bar (±10%), can be replaced by medium pressure carrier air/cooling air supply, for example, in the range of about 10-22 bar (±10%), i.e. air, which is not taken from the very last compressor stage but from an intermediate stage. The advantages can be as follows:

The overall gas turbine efficiency can increase. The cooling air bypasses the high-pressure turbine but at least medium pressure carrier air/cooling air can be compressed to a lower pressure level compared to high-pressure carrier/cooling air and does not need to be cooled down.

The design of the cooling air passage can be simplified.

The fuel can be shielded in order to slow down the reactivity of the fuel air mixture Sufficient cooling is provided to the lance.

The momentum flux of the fuel needn't be increased, if the injector is designed accordingly, i.e. if the dependence of the mixing behavior on the momentum flux ratio is weak.

The cross flow fuel jet underlying principle of the known SEV can incur relatively high-pressure drop due to complex flow features and high momentum flux of the fuel jet. The supply fuel pressure for the SEV is drawn from the EV gas compressors, which can be high in order to obtain a high momentum flux ratio (for example, around 8). The fuel gas pressure requirements for the reheat fuel lances should however be decreased in order to minimize the hardware costs and auxiliary power consumption by modifying the gas compressors for future engines.

With respect to performing a reasonable fuel air mixing, the following components of current burner systems should be considered:

At the entrance of the SEV combustor, the main flow should be conditioned in order to provide uniform inflow conditions independent of the upstream disturbances, for example, caused by the high-pressure turbine stage.

Then, the flow should pass four vortex generators.

For the injection of gaseous and liquid fuels into the vortices, fuel lances can be used, which extend into the mixing section of the burner and inject the fuel(s) into the vortices of the air flowing around the fuel lance.

To this end FIG. 1 shows a known secondary burner 1. The burner, which can be an annular combustion chamber or one with rectangular cross-section, is bordered by opposite walls 3. These opposite walls 3 define the flow space for the flow 14 of oxidizing medium. This flow enters as a main flow 8 from the high pressure turbine, i.e. behind the last row of rotating blades of the high pressure turbine which is located downstream of the first combustor. This main flow 8 enters the burner at the inlet side 6. First this main flow 8 passes flow conditioning elements 9, which can be turbine outlet guide vanes which are stationary and bring the flow into the proper orientation. Downstream of these flow conditioning elements 9 vortex generators 10 are located in order to prepare for the subsequent mixing step. Downstream of the vortex generators 10 there is provided an injection device or fuel lance 7 which can include a foot 16 and an axial shaft 17 extending further downstream like a rod. At the most downstream portion of the shaft 17 fuel injection takes place, in this case fuel injection takes place via orifices/nozzles which inject the fuel in a direction perpendicular to flow direction 14 (cross flow injection).

Downstream of the fuel lance 7 there is the mixing zone 2, in which the air, bordered by the two walls 3, mixes with the fuel and then at the outlet side 5 exits into the combustion space 4 where self-ignition takes place.

At the transition between the mixing zone 2 and the combustion space 4 there can be a transition 13, which can be in the form of a step, or as indicated here, can be provided with round edges and also with stall elements for the flow. The combustion space is bordered by the combustion chamber wall 12.

This leads to a fuel mass fraction contour 11 at the burner exit 5 as indicated on the right side of FIG. 1.

The fuel lance is equipped with a carrier air passage, which can be needed for the following reasons:

The carrier air can slow down the reactivity of the fuel air mixture by local effects on both, temperature and equivalence ratio.

The carrier air can be used for cooling the lance.

Known SEV-burners can be designed for operation on natural gas and oil. The carrier air increases the momentum flux of the fuel in order to penetrate the vortices and allow a good fuel air mixing behavior.

The system, due to the last requirement given above, should have carrier air, normally taken from the last compressor stage of the gas turbine and this carrier air can need to be cooled down. This can have the following drawbacks:

The high-pressure carrier air drawn from the last compressor stage can bypass the high pressure turbine thus resulting in efficiency losses.

The cooling down of the high-pressure carrier air can result in additional efficiency losses.

The further drawback is related to the complicated design of the known SEV system.

The cooling air of the burner for cooling the combustion chamber walls 12 as well as the walls 2 of the combustor and the lance can be taken from a low pressure air plenum. The air is then cooling both, the burner and the front panel 13 with effusion cooling. The desirability for additional high-pressure cooled down carrier air for the assistance of the fuel injection process and the cooling of the lance can result in additional design efforts for the high-pressure carrier air supply.

With the cooling scheme and injector design according to exemplary embodiments of the disclosure, the drawbacks of using high-pressure carrier air can be avoided.

With low enough fuel pressure requirements, as made possible by using streamlined bodies as fuel injection devices combined with in-line fuel injection, a sequential burner can be fed without fuel compression i.e. it is possible to feed the sequential burner with network pressure only (in the range of about 10-20 bar (±10%), as compared to high-pressure which is in the range of about 25-35 bar (±10%)). At the same time carrier air pressure can then be as low as in the range of about 10-22 (±10%) bar for the assistance of this in-line injection process, so cooled down high-pressure carrier air with pressures in the range of 25-35 bar is not necessary any more. However, such low pressure carrier air can then still be efficiently used at the same time for cooling of the lance, as it is desirable to use the carrier air supply used for assisting the fuel injection at the same time also for cooling the lance, as described below.

Flutelike injectors with an aerodynamically optimized lance body are considered as injectors. The body is designed to mitigate non-uniformities of the flow, which can come from the high pressure turbine. The fuel injector can be arranged to allow axial injection of the fuel. In order to enhance the spreading of the jets, large scale mixing devices can be incorporated. In water channel tests, the dependence upon the momentum flux ratio was determined. It was seen that the mixing behaviour of the in-line-configuration hardly depends on the momentum flux ratio, thus not requiring high pressure carrier air for the sake of momentum flux ratio.

A cooling scheme can be provided for the fuel lance, which can perform the cooling as well as the fuel shielding at a reasonable pressure drop.

Herein, effusion cooling, impingement cooling and convective cooling can be combined in order to yield the desired performance.

Exemplary embodiments of the disclosure are described in the following to combine the cooling to the fuel shielding.

In an exemplary embodiment of the disclosure the cooling of the lance balcony 18 can be carried out as impingement cooling. After cooling the lance balcony 18, the cooling air enters a carrier air plenum 51. The plenum 51 can be equipped with several holes 56. These are chosen in diameter as such that a uniform distribution of the carrier air along the injectors can be provided. From the carrier plenum 51, the air impinges the inner side of the leading edge of the injectors or flutes 22. The air then cools the sidewall convectively. The cooling air leaves the injector through various passages, for example, three passages. This can be the large scale mixing devices 23 (for example, vortex generators), the trailing edge 24 and/or annular slits at the injector holes. The split between each of the passages vortex generators 23, trailing edge 24 and injector 15 holes can be adjusted to allow sufficient cooling of the components and a combustion behaviour as desired. Within each of the passages, the cross section can be designed as such that the critical area is close to the exit of the passage, to provide uniform cooling air distribution.

In more detail this concept shall be discussed with reference to FIGS. 2-5. In this first exemplary embodiment according to the disclosure, a burner arrangement is given, in which three bodies 22 or lances are elements of a burner arrangement with three such flutes or streamlined bodies 22. This burner arrangement is to be located in the wall 3 of a burner set-up as illustrated in FIG. 1.

The burner arrangement includes a burner plate 18, also called a balcony, to which the three bodies 22 are attached next to each other (with slightly different inclination angles with respect to the main flow direction 14). They extend into the mixing space or mixing zone 2.

Each of these bodies 22 has an outer wall 37 with two lateral surfaces 33 which are arranged substantially parallel to the main flow 14 of the combustion gases.

This outer wall 37 forms a cavity within the body 22 which at the leading edge 25 joins the two lateral walls 33 in a rounded manner, while at the trailing edge 24 the lateral walls form a sharp edge, similar to a wing like structure.

The leading edge 25 and the trailing edge 24 are substantially parallel to each other along a longitudinal direction and extend perpendicularly to the main flow direction 14 of the combustion gases. Such a burner arrangement is thus located in a secondary combustion chamber of a gas turbine.

In this cavity formed by the outer wall 37 there is located, in the region adjacent to the leading edge, a carrier air channel or carrier air plenum 51, which is given as a tubular or channel like structure.

In the trailing edge region of this cavity formed by the outer wall 37, there is located a longitudinal inner fuel tubing 36 for fuel supply of the nozzles 15, which are located at the trailing edge 24, and which are provided for inline injection of the fuel. The fuel, in this case gaseous fuel, is transported via the fuel gas feed 30 to the burner arrangement and then into this inner fuel tubing channel 36 and is subsequently distributed to the individual fuel nozzles 15 by branching off tubings 39. These branching of tubings are arranged substantially parallel to the main flow direction of the combustion gases. In the regions between the individual branching of tubings 39 between the two yet distanced opposite walls 37 there are located distancing elements 63.

The carrier air plenum 51 in the region facing the inner side of wall 37 is defined by a wall which is located substantially parallel to wall 37. Between these two walls there is an interspace 52 through which carrier air can flow. The distance between the two walls can be established/maintained by distance keeping elements 53.

Also the walls of the inner fuel tubing 36, where facing the wall 37, are substantially parallel but distanced from the outer wall structure 37 and again maintained in this distance by distance keeping element 53. Also in this interspace carrier air may flow.

The two channels 51 and 36 are also distanced from each other by interspace 55, through which can flow carrier air.

The interspace between the walls 37 is, at the side opposite to the burner plate 18, closed by a bottom plate 59 which is arranged substantially parallel to the plate 18.

Above the burner plate 18 there is located a cavity 26, which on its bottom side faces the mixing chamber and on its upper side is bordered by an outer wall 19. The cavity 26 is furthermore circumferentially enclosed by a side wall 41.

Into this cavity 26 the fuel feed duct 30 is guided and then delivered to the inner fuel tubing, i.e. its longitudinal part 36. As three lances are combined in one such burner arrangement, there is one supply line 30 for the central lance and one further supply line 30' for the two outer lances, the gaseous fuel is distributed to the outer lances via individual distribution tubes 60. It is however also possible to have one single fuel feed which then distributes to all three fuel lances or to have individual fuel feeds for each fuel lance.

On its upper side the outer wall 19 is connected, via a flange 62, to a comparatively low pressure supply of carrier air, typically with a pressure in the range of about 10-22 bar (±10%).

This carrier air, which is derived from the compressor stage of the corresponding necessary pressure without subsequent cooling, enters the cavity 26 via the carrier gas feed 31. It correspondingly cools the upper parts of the burner arrangement located within the cavity 26 so, for example, the fuel tubing 30 and distribution line 60. It then flows, as indicated by arrows 64, towards the burner plate 18. Distanced from the burner plate 18, according to this first exemplary embodiment, there is located a perforated plate 57 with holes 61 forming interspace 58 between the burner plate 18 and plate 57. The carrier air 65 penetrates these holes 61 and in a first cooling step cools the balcony 18 by impingement cooling and subsequent convective cooling. So after this impingement cooling it also cools the balcony by convective cooling because the carrier air is subsequently guided into the carrier air channel 51 from the top side as indicated schematically by arrows 72.

The carrier air then travels downwards towards the bottom part of the lance 22. As the wall of the carrier air plenum 51 is perforated at least where facing the leading edge 25, carrier air exits the channel 51 via these holes and cools the leading edge 25, specifically the inner side of the wall thereof, by impingement cooling.

Subsequent to this impingement cooling the carrier air travels downwards and backwards towards the trailing edge 24 of the lance and at the same time convectively cools the wall 37 as well as shields the inner fuel tubing 36 by travelling through interspaces 52, 55 and 38.

One part of this carrier air (first fraction) travels towards the nozzles 15 and along the outer wall of the branching off tubings 39 to exit into the mixing chamber via the annular slots 71, such that a carrier air sleeve encloses the fuel jet 34 exiting, also in an annular fashion, a fuel exit slot defined by the inner side of the wall of 39 and a central element 50. So this first fraction of carrier air exits the injection device 22 taking the function of true carrier air for fuel injection.

A second fraction of this carrier air travels between the walls 37 across the distancing elements 63 and exits the injection device at its trailing edge 24, where corresponding holes/slots are provided for effusion cooling.

A third fraction of this carrier air exits the injection device via vortex generators 23 which are located on the surface of the walls 37 upstream of the nozzles 15. To this end, these vortex generators 23 are provided with film cooling holes 32 through which, after having entered cavity 54, the carrier air penetrates into the mixing chamber.

In this case three lances 22 are combined within one burner arrangement, it is however also possible to have one burner with one lance or a burner arrangement with two lances or whichever is most appropriate for installation and/or maintenance purposes.

Figure 3:
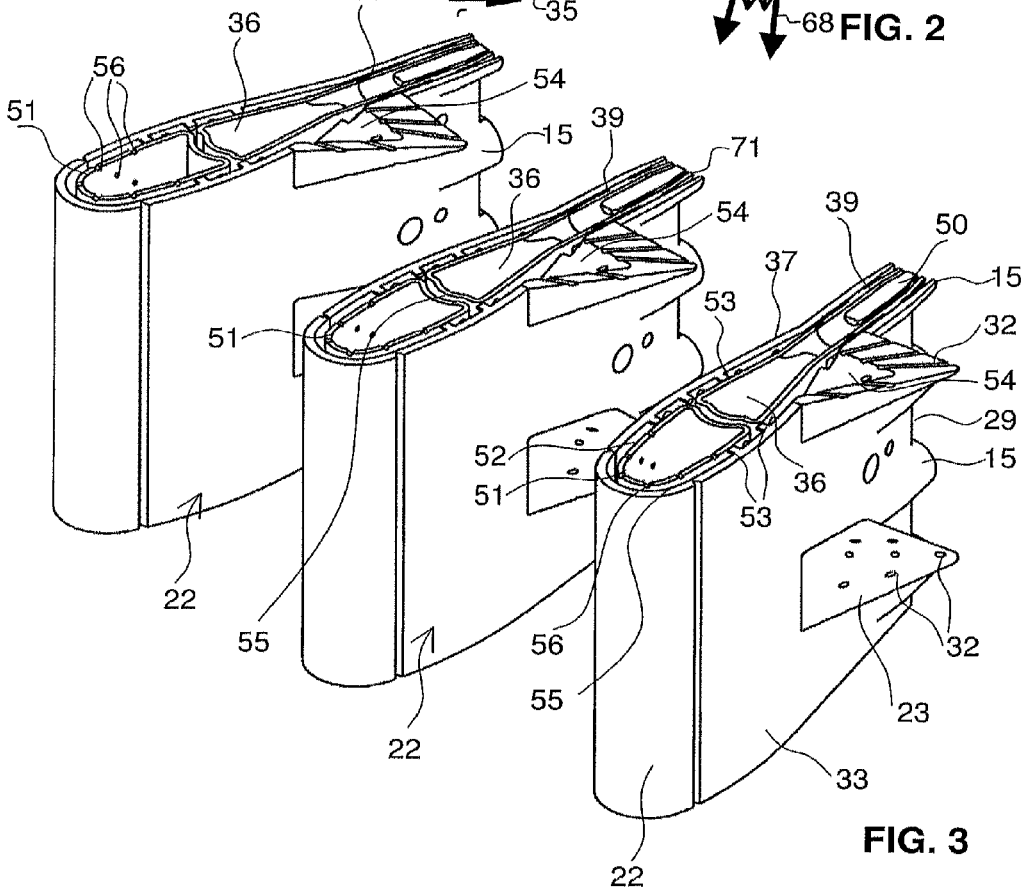
FIG. 3 shows a perspective view onto the group of lance bodies according to an exemplary embodiment of the disclosure and their interior structure.
Figure 4:
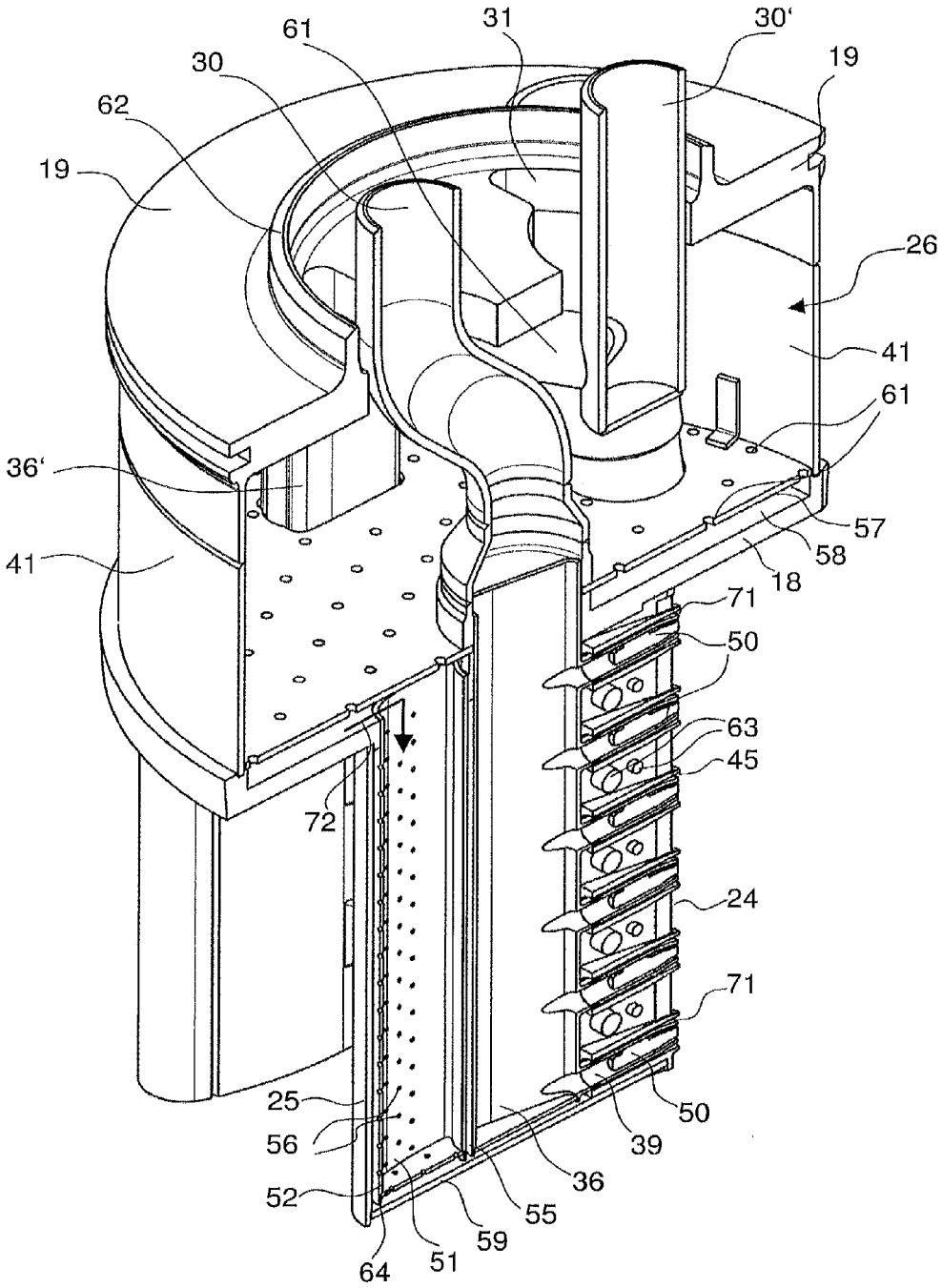
FIG. 4 shows a perspective view onto one half of the lance arrangement according to an exemplary embodiment of the disclosure wherein the outer wall structure on the upper part is present.
Figure 5:
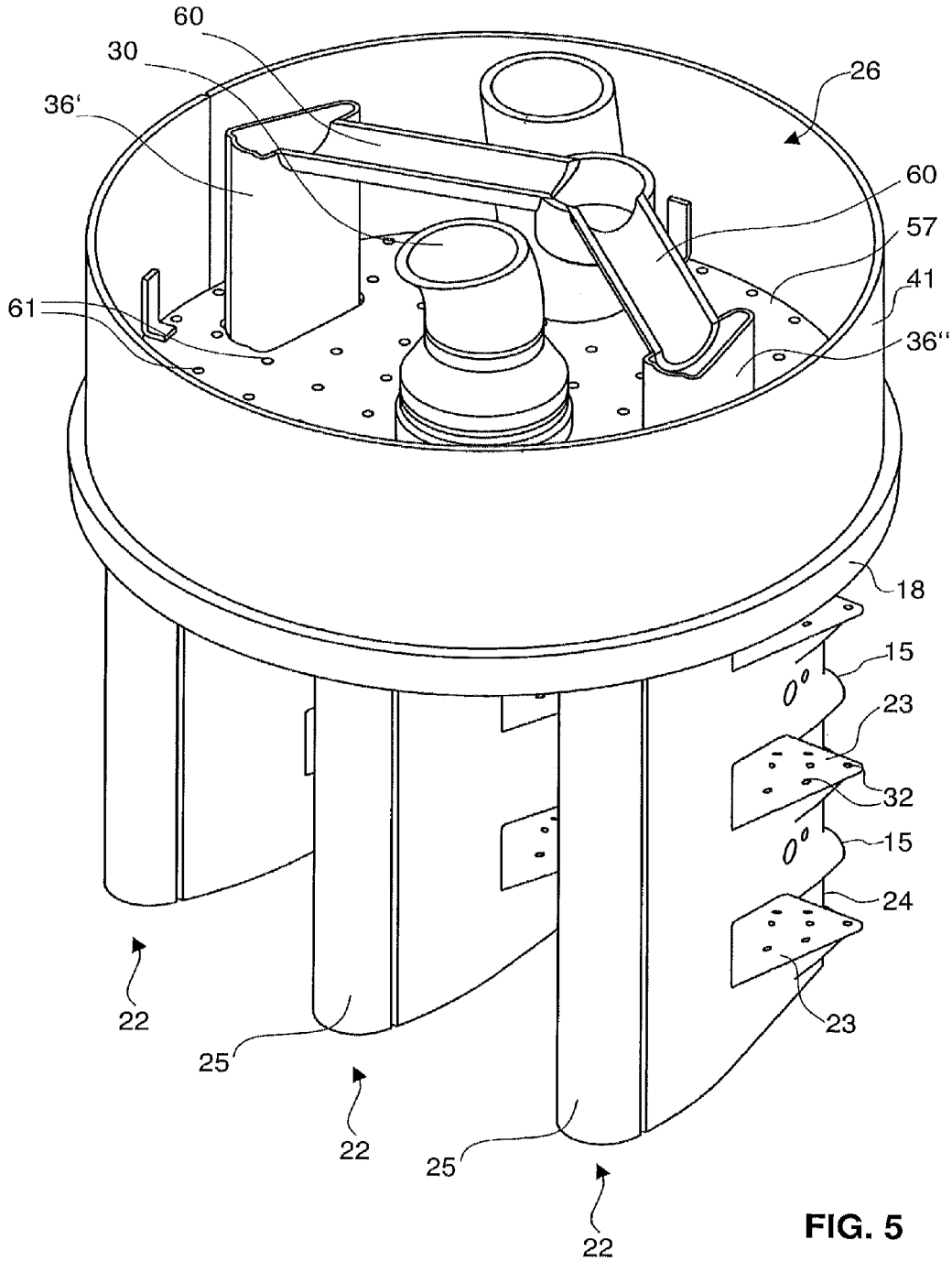
FIG. 5 shows a perspective view onto a complete lance arrangement according to an exemplary embodiment of the disclosure wherein the outer wall structure on the upper part is removed.

Three bodies 22 arranged within an annular secondary combustion chamber are given in perspective view in FIG. 3, wherein the bodies are cut perpendicularly to the longitudinal axis 49 to show their interior structure.

In the cavity formed by the outer wall 37 of each body on the trailing side thereof there is located the longitudinal inner fuel tubing 36. It is distanced from the outer wall 37, wherein this distance is maintained by distance keeping elements 53 provided on the inner surface of the outer wall 37.

From this inner fuel tubing 36 the branching off tubing extends towards the trailing edge 29 of the body 22. The outer walls 37 at the position of these branching off tubings 39 is shaped such as to receive and enclose these branching off tubings 39 forming the actual fuel nozzles 15 with orifices located downstream of the trailing edge 29.

In the substantially cylindrically shaped interior of the branching off tubings 39 there is located a cylindrical central element 50 which leads to an annular stream of fuel gas. As between the wall of the branching off tubings 39 and the outer walls 37 at this position there is also substantially annular interspace. The annular stream of fuel gas at the exit of the nozzle is enclosed by an substantially annular carrier gas stream.

Towards the leading edge 25 of the body 22 in the cavity formed by the outer wall 37 of the body in this exemplary embodiment there is located the carrier air tubing channel 51 extending substantially parallel to the longitudinal inner fuel tubing channel 36. Between the two channels 36 and 51 there is an interspace 55. The walls of the carrier air tubing channel 51 facing the outer walls 37 of the body 22 run substantially parallel thereto again distanced therefrom by distancing elements 53. In the walls of the carrier air tubing channel 51 there are provided cooling holes 56 through which carrier air travelling through channel 51 can penetrate. Air penetrating through these holes 56 impinges onto the inner side of the walls 37 leading to impingement cooling in addition to the convective cooling of the outer walls 37 in this region.

Within the walls 37 there are provided the vortex generators 23 in a manner such that within the vortex generators, cavities 54 are formed which are fluidly connected to the carrier air feed. From these cavities the effusion/film cooling holes 32 branch off for the cooling of the vortex generators 23. Depending on the exit point of these holes 32 they are inclined with respect to the plane of the surface at the point of exit in order to allow efficient film cooling effects.

In an exemplary embodiment according to the disclosure, the cooling of the lance balcony 18 can be carried out as effusion cooling, which can result in a lower pressure drop of the arrangement. After cooling the lance balcony 18, the cooling air enters a carrier air plenum 51. The plenum 51 is equipped with several holes 56. These are chosen in diameter such that a uniform distribution of the carrier air along the injectors can be provided. From the carrier plenum 51, the air impinges the leading edge 25 of the injectors. The air then cools the sidewall convectively. The cooling air leaves the injector through various passages, for example, three passages. This may be large scale mixing devices 23 (for example, vortex generators), the trailing edge 25 or annular slits at the injector holes. The split between each of the passages vortex generators, trailing edge and injector holes can be adjusted to allow sufficient cooling of the components and a combustion behaviour as desired. Within each of the passages, the cross section is arranged as such that the critical area is close to the exit of the passage, thus ensuring uniform cooling air distribution.

Figure 2:
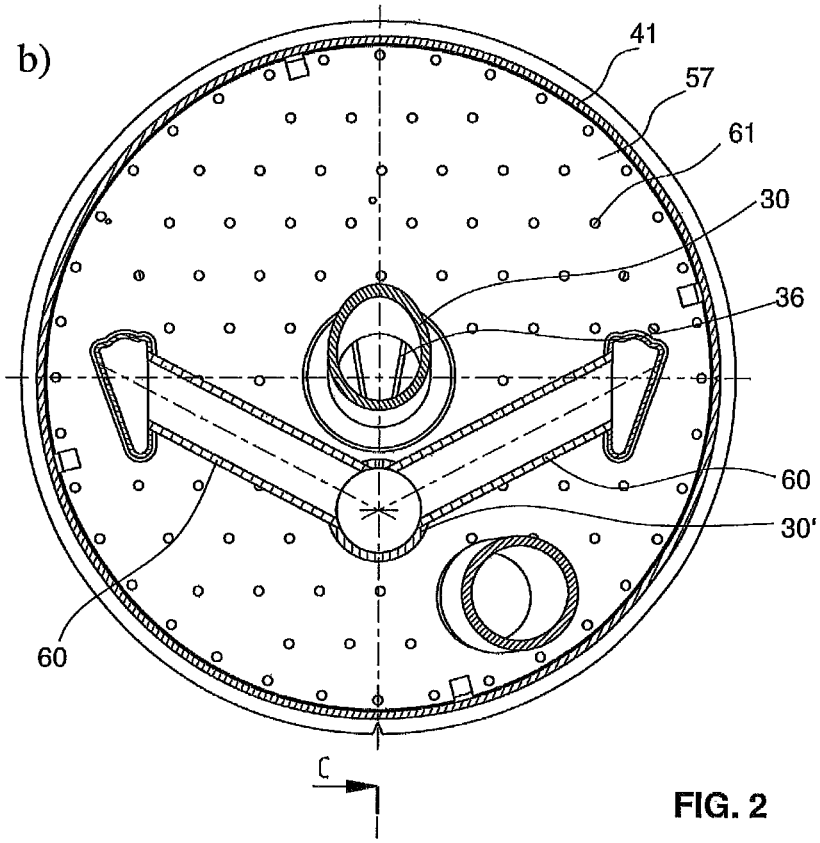
FIG. 2 shows an aerodynamically optimised lance arrangement according to an exemplary embodiment of the disclosure in a central axial cut through the central lance in a), in b) a cut along the line A in a), and in c) a cut along C-C in a)
Figure 2:
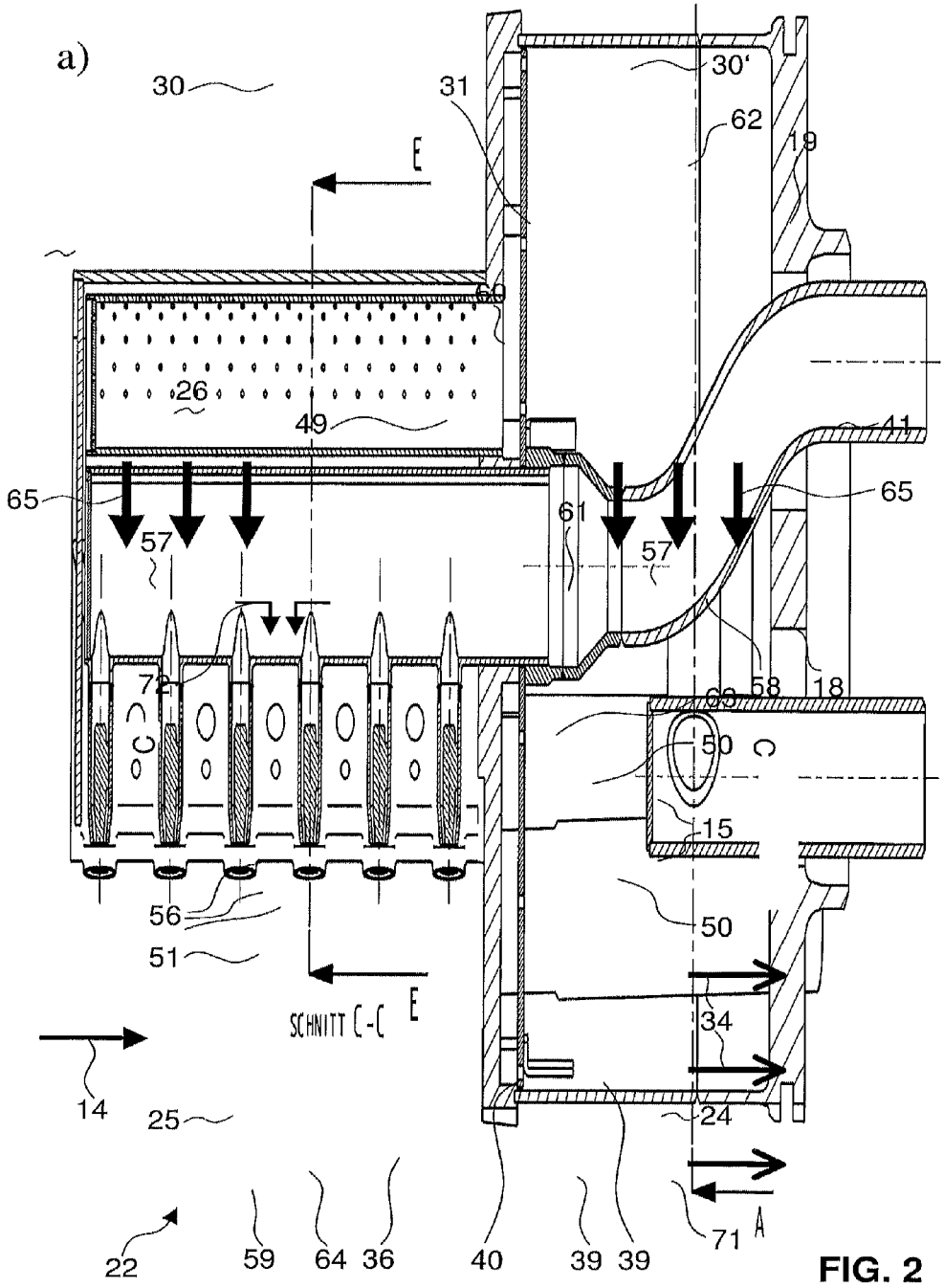
Figure 2:
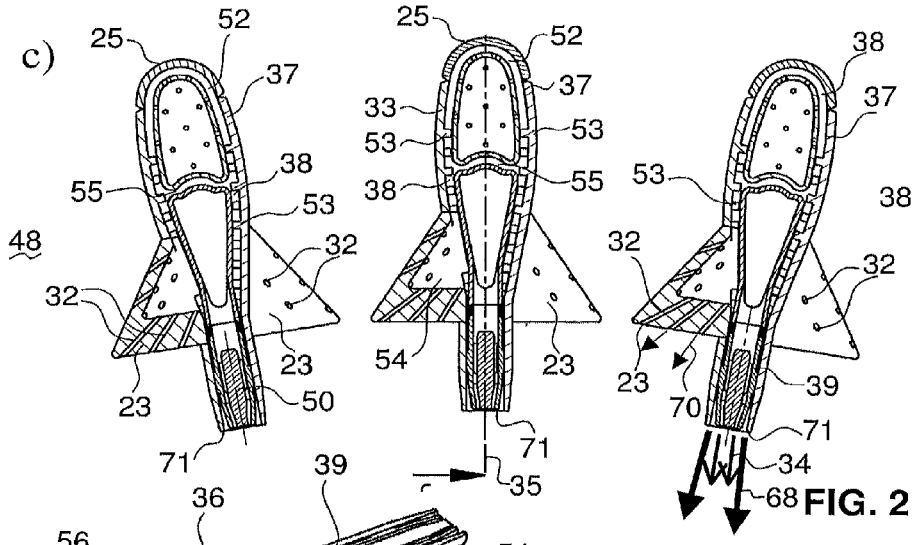
Figure 6:
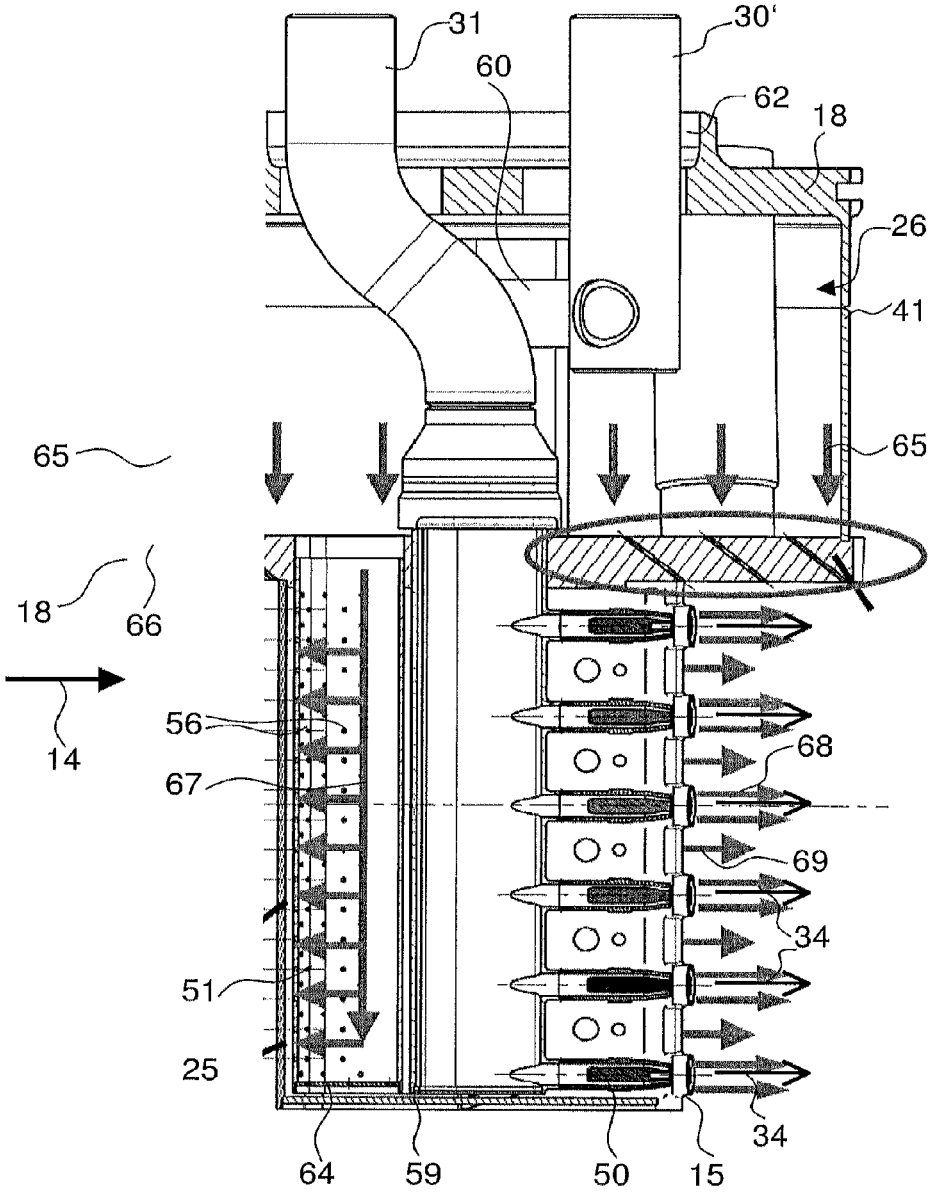
FIG. 6 shows an aerodynamically optimised lance arrangement according to an exemplary embodiment of the disclosure in a central axial cut through the central lance.

In this exemplary embodiment there is no hole plate 57 separating the cavity 26 from the burner plate 18 and correspondingly there is no effusion/impingement cooling in the interspace 58. In this case the cavity 26 is directly adjacent to the structure of the burner plate 18, and the burner plate 18 is cooled by holes 66 provided in the burner plate 18, wherein these effusion/film cooling holes 66 can be inclined with respect to the plane of the burner plate such that air exiting these effusion holes 60 is at an oblique angle with the main flow 40 leading to efficient film cooling on the surface of the plate 18. In this exemplary embodiment the cooling air 65 in the cavity 26 flows onto the inner surface of the burner plate 18 and a fraction thereof can penetrate through the holes 66 for effusion cooling of the plate 18. This can be only a minor fraction, the major fraction of the carrier air can enter the carrier air plenum 51 under generation of a cooling air flow as indicated by arrow 67 in FIG. 6. It can then penetrate through the holes 56 leading to impingement cooling of the inner side of the leading edge wall structure 25 of the lance. It can then travel in the interspaces 52, 55 and 38 again towards the trailing edge and exits either as true carrier air for fuel injection as indicated by arrow 68 via the exits slots 71, or it exits via the trailing edge as indicated by arrow 69, or it exits, in a manner similar as illustrated in FIG. 2, via the effusion/film cooling holes 32 in the vortex generators 23.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 burner
2 mixing space, mixing zone
3 burner wall
4 combustion space
5 outlet side, burner exit
6 inlet side
7 injection device, fuel lance
8 main flow from high-pressure turbine
9 flow conditioning, turbine outlet guide vanes
10 vortex generators
11 fuel mass fraction contour at burner exit 5
12 combustion chamber wall
13 transition between 3 and 12
14 flow of oxidizing medium
15 fuel nozzle
16 foot of 7
17 shaft of 7
16 foot of 7
17 shaft of 7
18 burner plate, balcony
19 outer wall
20 tube forming 18
22 streamlined body, lance
23 vortex generator on 22
24 trailing edge of 22
25 leading edge of 22
26 cavity
27 lateral surface of 23
28 side surface of 23
29 trailing edge of 23
30 fuel gas feed
31 carrier gas feed
32 film cooling holes
33 lateral surface of 22
34 ejection direction of fuel/carrier gas mixture
35 central plane of 22
36 inner fuel tubing, longitudinal part
37 outer wall of 22
38 interspace between 36 and 37
39 branching off tubing of inner fuel tubing
40 transition region between 36 and 39
41 sidewall
48 cross-sectional profile of 22
49 longitudinal axis of 22

50 central element
51 carrier air channel, carrier air plenum
52 interspace between 37 and 51
53 distance keeping elements
54 cavity within 23
55 interspace between 51 and 36
56 cooling holes
57 hole plate
58 interspace between 18 and 57
59 bottom plate of 22
60 distribution tube
61 holes in 57
62 flange
63 distancing elements
64 bottom plate of 51
65 cooling air in 26
66 effusion holes in 18
67 cooling airflow in 51
68 carrier air flow surrounding fuel jet
69 cooling airflow at trailing edge
70 cooling airflow out of 23
71 annular slit of ejection device
72 carrier air flow entering the plenum 51 from interspace 58

What is claimed is:

1. A burner for a combustion chamber of a turbine, comprising:

an injection device for the introduction of at least one gaseous and/or liquid fuel into the burner, wherein the injection device includes:

at least one body which is arranged in the burner, the at least one body being a streamlined body which has a streamlined cross-sectional profile and which extends with a longitudinal direction perpendicularly or at an inclination to a main flow direction prevailing in the burner, wherein the body has an outer wall including two lateral surfaces substantially parallel to the main flow direction joined at their upstream side by a leading edge portion of the body and joined at their downstream side forming a trailing edge defining the streamlined cross-sectional profile, wherein within the outer wall, there is provided a longitudinal inner carrier air plenum with a wall distanced from the outer wall leaving an interspace therebetween for the introduction of carrier air into the injection device, wherein the carrier air plenum is provided with holes such that carrier air exiting through these holes impinges on an inner side of the leading edge portion of the body of the outer wall; and at least two nozzles for introducing the at least one fuel into the burner, the at least two nozzles being distributed along the trailing edge of the streamlined body.

2. The burner according to claim 1, wherein the carrier air plenum comprises:

a tubular duct located in the upstream portion of a cavity defined by the outer wall, wherein a wall of the tubular duct forms the wall distanced from the outer wall leaving the interspace in between for circulation of the carrier air, wherein the wall of the tubular duct, in a region facing the outer wall, runs substantially parallel there to, and wherein a distance between the wall of the tubular duct and the outer wall is established by at least one distance keeping element at at least one of the outer wall and the wall of the tubular duct.

3. The burner according to claim 2, wherein the carrier air plenum extends substantially along a full length of the body terminated by a bottom plate, which is provided with holes for cooling of the bottom plate of the body.

4. The burner according to claim 1, wherein air exiting from the carrier air plenum is used as carrier air of the injection device, wherein the carrier air exits at the injection device via an annular slit enclosing a central fuel jet, wherein the central fuel jet exits via an annular fuel slit.

5. The burner according to claim 1, comprising:

a longitudinal inner fuel tubing;

wherein within the enclosing outer wall defining the streamlined cross-sectional profile, there is provided the longitudinal inner fuel tubing for an introduction of at least one of liquid and gaseous fuel, with branching off tubing leading to the at least two nozzles, wherein the carrier air plenum is located in an upstream portion of the cavity defined by the outer wall while the longitudinal inner fuel tubing is located in a downstream portion of the cavity defined by the outer wall, wherein a wall of the carrier air plenum is distanced from a wall of the longitudinal inner fuel tubing for circulation of carrier air.

6. The burner according to claim 5, wherein the longitudinal inner fuel tubing is circumferentially distanced from the outer wall, defining the interspace for the delivery of carrier air to the at least two nozzles.

7. The burner according to claim 1, comprising:

effusion holes, wherein air exiting from the carrier air plenum exits the injection device via the effusion holes, wherein the effusion holes are located at at least one of the trailing edge of the injection device, the lateral surfaces, the leading edge and large scale mixing devices of the injection device.

8. The burner according to claim 1, wherein the at least two nozzles have their outlet orifices downstream of the trailing edge of the streamlined body, wherein the distance (d) between an essentially straight trailing edge at the position of a nozzle, and the outlet orifice of the nozzle, measured along the main flow direction, is at from 2 mm-10 mm.

9. The burner as claimed in claim 1, wherein the streamlined body comprises:

a cross-sectional profile which is mirror symmetric with respect to the central plane of the body.

10. The burner according to claim 1, comprising:

at least one nozzle inclined with respect to the flow direction.

11. The burner according to claim 5, comprising:

a second inner fuel tubing wherein within the longitudinal inner fuel tubing provided for gaseous fuel there is provided the second inner fuel tubing for a second type of fuel, wherein the second type of fuel is a liquid fuel and wherein gaseous fuel is delivered by a second interspace between the walls of said longitudinal inner fuel tubing and the walls of the second inner fuel tubing.

12. The burner as claimed in claim 1, comprising:

at least one vortex generator wherein upstream of the at least one nozzle on at least one lateral surface there is located the at least one vortex generator, wherein the vortex generator has an attack angle in the range of 15-40° and/or a sweep angle in the range of 40-70°, wherein at least two nozzles are arranged at different positions along the trailing edge, wherein upstream of each of these nozzles at least one vortex generator is located, and wherein vortex generators to adjacent nozzles are located at opposite lateral surfaces.

13. The burner according to claim 12, comprising:

cooling elements provided for the at least one vortex generators, wherein the cooling elements are effusion cooling holes provided in at least one surface of the vortex generator, and the effusion cooling holes are fed with air from the carrier gas feed also used for the fuel injection.

14. The burner according to claim 1, wherein the streamlined body extends across substantially the entire flow cross section between opposite walls of the burner, wherein the burner is an annular burner arranged circumferentially with respect to a turbine axis, and wherein between 10-100 streamlined bodies, are arranged around the circumference distributed equally along the circumference.

15. The burner according to claim 1, wherein the fuel is injected from the nozzle together with a carrier air stream which is supplied by the carrier air plenum, and wherein the carrier air is low pressure air with a pressure in the range of 10-22 bar, and wherein this carrier air is directly derived from a compressor stage without subsequent cooling.

16. The burner according to claim 1 in combination with a turbine combustion chamber configured for combustion under high reactivity conditions, and/or for the combustion at high burner inlet temperatures and/or for combustion of MBtu fuel with a calorific value of 5000-20,000 kJ/kg.

17. The burner as claimed in claim 12, comprising:

at least four nozzles arranged along the trailing edge and vortex generators alternatingly located at the two lateral surfaces and downstream of each vortex generator there are located at least two nozzles.

* * * * *